US006037920A

United States Patent [19]

Mizutome et al.

[11] Patent Number: 6,037,920

[45] Date of Patent: Mar. 14, 2000

[54] LIQUID CRYSTAL APPARATUS AND DRIVING METHOD THEREFOR

[75] Inventors: Atsushi Mizutome, Hayamamachi; Osamu Taniguchi, Chigasaki, both of Japan

[73] Assignee: Canon Kabushiki Kaisha, Tokyo, Japan

[21] Appl. No.: 09/037,610

[22] Filed: Mar. 10, 1998

[30] Foreign Application Priority Data

Mar. 13, 1997 [JP] Japan ..... 9-059621

[51] Int. Cl.[7] ..... G09G 3/36

[52] U.S. Cl. ..... 345/87; 345/94; 345/101; 345/148; 349/72

[58] Field of Search ..... 345/94, 101, 103, 345/208, 87, 148; 349/72

[56] References Cited

U.S. PATENT DOCUMENTS

| | | | |
|---|---|---|---|
| 4,738,515 | 4/1988 | Okada et al. | 350/350 S |
| 4,804,951 | 2/1989 | Yamashita et al. | 340/719 |
| 4,878,740 | 11/1989 | Inaba et al. | 350/337 |
| 4,902,107 | 2/1990 | Tsuboyama et al. | 350/350 S |
| 4,958,915 | 9/1990 | Okada et al. | 350/345 |
| 5,026,144 | 6/1991 | Taniguchi et al. | 350/350 S |
| 5,041,821 | 8/1991 | Onitsuka et al. | 340/784 |
| 5,058,994 | 10/1991 | Mihara et al. | 359/56 |
| 5,066,945 | 11/1991 | Kanno et al. | 340/784 |
| 5,091,723 | 2/1992 | Kanno et al. | 340/784 |
| 5,113,181 | 5/1992 | Inoue et al. | 340/783 |
| 5,182,549 | 1/1993 | Taniguchi et al. | 340/784 |
| 5,228,114 | 7/1993 | Suzuki | 392/415 |
| 5,267,065 | 11/1993 | Taniguchi et al. | 359/56 |
| 5,317,332 | 5/1994 | Kanno et al. | 345/101 |
| 5,488,388 | 1/1996 | Taniguchi et al. | 345/97 |
| 5,506,601 | 4/1996 | Mihara et al. | 345/103 |
| 5,521,727 | 5/1996 | Inaba et al. | 359/56 |
| 5,592,191 | 1/1997 | Tsuboyama et al. | 345/97 |
| 5,602,562 | 2/1997 | Onitsuka et al. | 345/101 |
| 5,606,343 | 2/1997 | Tsuboyama et al. | 345/97 |
| 5,691,740 | 11/1997 | Onitsuka et al. | 345/96 |
| 5,726,679 | 3/1998 | Kanno et al. | 345/100 |
| 5,863,458 | 1/1999 | Miyata et al. | 252/299.01 |
| 5,886,678 | 3/1999 | Katakura et al. | 345/94 |

FOREIGN PATENT DOCUMENTS

| | | |
|---|---|---|
| 62-118326 | 5/1987 | Japan . |
| 63-44636 | 2/1988 | Japan . |
| 6-230751 | 8/1994 | Japan . |
| 60-123825 | 7/1995 | Japan . |
| 7-175041 | 7/1995 | Japan . |

OTHER PUBLICATIONS

N.A. Clark, S.T. Lagerwall, "Structures and Applications of SSFLC Devices", Proceedings of the 6th International Display Research Conference, Japan Display '86, Sep. 30–Oct. 2, 1986, Keidanren Kaikan, Otemachi, Chiyoda–ku, Tokyo, Japan.

*Primary Examiner*—Richard A. Hjerpe
*Assistant Examiner*—Kimnhung Nguyen
*Attorney, Agent, or Firm*—Fitzpatrick, Cella, Harper & Scinto

[57] ABSTRACT

Based on temperature data from temperature detection means, the temperature of a liquid crystal device is judged to be present in which of prescribed plural temperature regions. Based on the judgment, in each temperature region, a drive voltage generation means is controlled to generate a constant drive voltage which is different from that in another region, and a drive signal generation means is controlled to generate a drive signal having a pulse width which varies depending on the temperature of the liquid crystal device. A liquid crystal disposed between a pair of substrates of the liquid crystal device is driven by application of the constant drive voltage for the pulse width of the drive signal. The drive system allows a sufficient temperature compensation by a relatively simple apparatus organization.

12 Claims, 6 Drawing Sheets

LIQUID CRYSTAL APPARATUS AND DRIVING METHOD THEREFOR

FIELD OF THE INVENTION AND RELATED ART

The present invention relates to a liquid crystal apparatus equipped with a liquid crystal device, particularly a liquid crystal device using a liquid crystal having a memory characteristic, and a driving method therefor including temperature compensation.

In recent years, attention has been called to liquid crystal apparatus using a memory-type liquid crystal, such as ferroelectric liquid crystal (FLC), anti-ferroelectric liquid crystal (AFLC) or bistable twisted nematic liquid crystal (BTN). This type of liquid crystal apparatus has an advantage of a large capacity display because of its memory characteristic but is accompanied with a difficulty that the device performance is liable to change on temperature change. Particularly, it is liable to exhibit a large temperature-dependence of optical characteristic during multiplex drive.

Several proposals for alleviating the difficulties by specific drive methods have been made, e.g., by Japanese Laid-Open Patent Application (JP-A) 60-123825, JP-A 62-118326 and JP-A 63-44636 for FLC, and by JP-A 7-175041 for BTN.

However, liquid crystal apparatus having adopted such drive methods are still accompanied with problems, such that sufficient temperature compensation cannot be effected over the entire operation temperature range of a liquid crystal device, or the temperature compensation method becomes complicated, thus requiring an expensive drive control circuit.

SUMMARY OF THE INVENTION

In view of the above-mentioned problems, a principal object of the present invention is to provide a liquid crystal apparatus having a simple structure yet capable of allowing a sufficient temperature compensation of a liquid crystal device, and a driving method for such a liquid crystal apparatus.

According to the present invention, there is provided a liquid crystal apparatus, comprising:

a liquid crystal device comprising a pair of substrates having thereon groups of electrodes disposed so as to form an electrode matrix, and a liquid crystal disposed between the substrates so as to be driven by a drive voltage based on a drive signal supplied via the electrodes, drive voltage generation means for generating a drive voltage for driving the liquid crystal, drive signal generation means for generating a drive signal corresponding to the drive voltage, temperature-detection means for detecting a temperature of the liquid crystal device, and control means for (i) setting plural different temperature regions, (ii) judging in which of the plural temperature regions the temperature of the liquid crystal device is present based on detected temperature data from the temperature-detection means, and (iii) in each temperature region, controlling the drive voltage generation means to generate a constant drive voltage different from that in another temperature region and controlling the drive signal generation means to generate a drive signal having a pulse width varying depending on the detected temperature data.

According to another aspect of the present invention, there is provided a driving method for a liquid crystal apparatus of the type including a liquid crystal device comprising a pair of substrates having thereon groups of electrodes disposed so as to form an electrode matrix, and a liquid crystal disposed between the substrates so as to be driven by a drive voltage based on a drive signal supplied via the electrodes, and temperature-detection means for detecting a temperature of the liquid crystal device; said driving method, comprising:

driving the liquid crystal device based on temperature data from the temperature detection means over an operational temperature range including a first temperature region and a second temperature region so that when the temperature of the liquid crystal device is in the first temperature region, a first constant drive voltage is applied to the liquid crystal device for a pulse width varying depending on the temperature of the liquid crystal device, and when the temperature of the liquid crystal device is in a second temperature region, a second constant voltage is applied to the liquid crystal for a pulse width varying depending on the temperature of the liquid crystal device.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
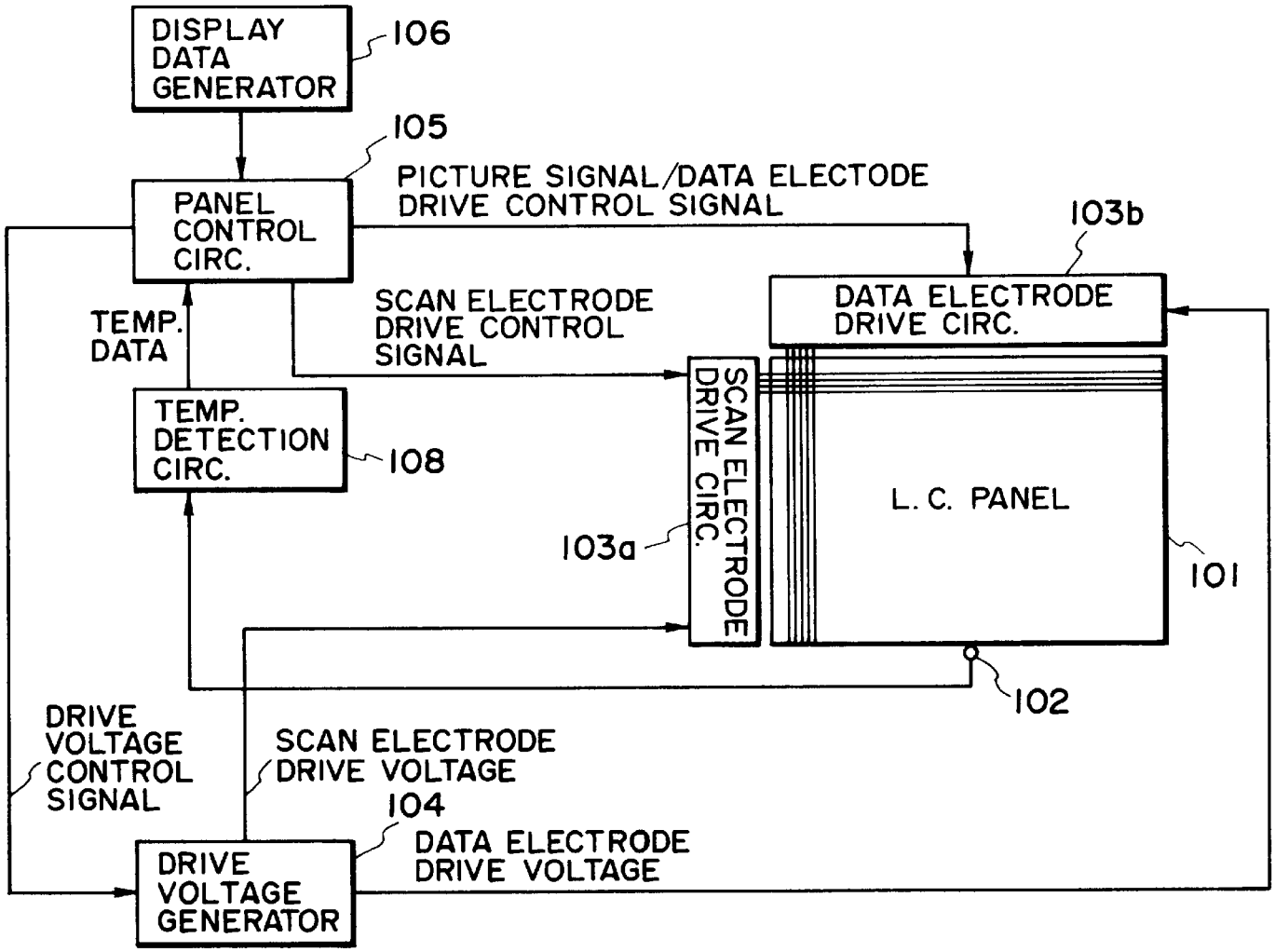
FIG. 1 is a block diagram of a liquid crystal apparatus according to the invention.

FIG. 1 is a schematic block diagram of a first embodiment of the liquid crystal apparatus according to the present invention. Referring to FIG. 1, the liquid crystal apparatus includes a liquid crystal panel (liquid crystal device) 101, a thermistor 102 for detecting a temperature of the liquid crystal panel 101. Temperature data from the transistor is designed to be inputted into a temperature-detection circuit 108 which constitutes a temperature detection means together with the thermistor 102 and then inputted to a panel control circuit 105.

Incidentally, a temperature-detection means in this embodiment is constituted as a thermistor 102 attached externally onto the liquid crystal panel 101, but such a thermistor can be incorporated within the liquid crystal panel 101 or replaced by a temperature-detector of the type of detecting a current passing through a pixel to detect the temperature of the liquid crystal panel 101.

The liquid crystal apparatus further includes a display data generating unit 106, from which display data is outputted and inputted to the panel control circuit 105 and converted into scanning address data and display data.

Based on the scanning address data and the temperature data from the temperature detection circuit, the panel control unit 105 as control means supplies a scanning electrode drive control signal to a scanning electrode drive circuit 103*a* is a drive signal generation means, and further the control circuit 105 supplies a data electrode drive control signal and picture signals to a data electrode drive control circuit 103*b* as another drive signal generation means based on the display data and the temperature data. On the other hand, the control circuit 105 further supplies a drive voltage control signal to a drive voltage generation circuit 104 as a drive voltage generation means depending on the temperature data.

The drive voltage generation circuit 104 generates prescribed scanning signal drive voltage and data signal drive voltage and supplies them to a scanning electrode drive circuit 103*a* and a data electrode drive circuit 103*b*, respectively, based on the drive voltage control signal from the panel control circuit 105. Based on the respective drive voltages from the drive voltage generation circuit 104 and the respective control signal and picture signals from the panel control circuit 105, the scanning electrode drive circuit 103*a* and the data electrode drive circuit 103*b* generate a scanning signal and data signals, respectively, and apply them to a liquid crystal panel 101 to drive the panel at a prescribed drive frequency and at a prescribed voltage.

Figure 2:
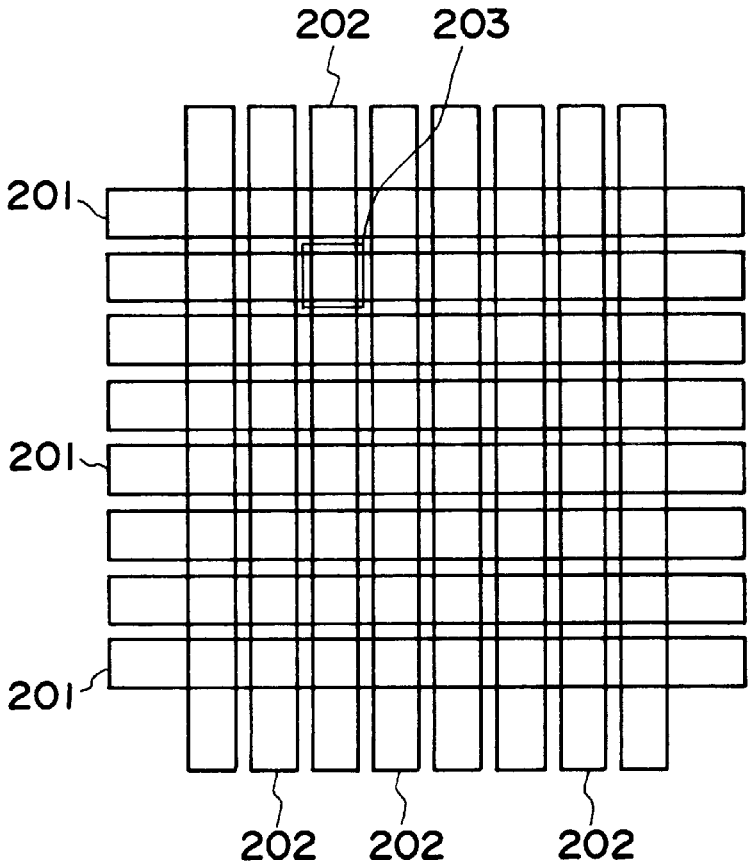
FIGS. 2 and 3 are a plan view and a sectional view, respectively, of a liquid crystal panel (liquid crystal device) in the liquid crystal apparatus of FIG. 1.

As shown in FIG. 2, for example, the liquid crystal panel 101 comprises scanning signal electrodes 201 and data signal electrodes 202 disposed on one or two glass substrates so as to intersect each other and form an electrode matrix, thereby providing a pixel 203 at each intersection of the electrodes. Incidentally, in this particular example, the liquid crystal panel 101 is designed to form a display area having a diagonal size of 15 inches and composed of 1280×1024 pixels.

Figure 3:
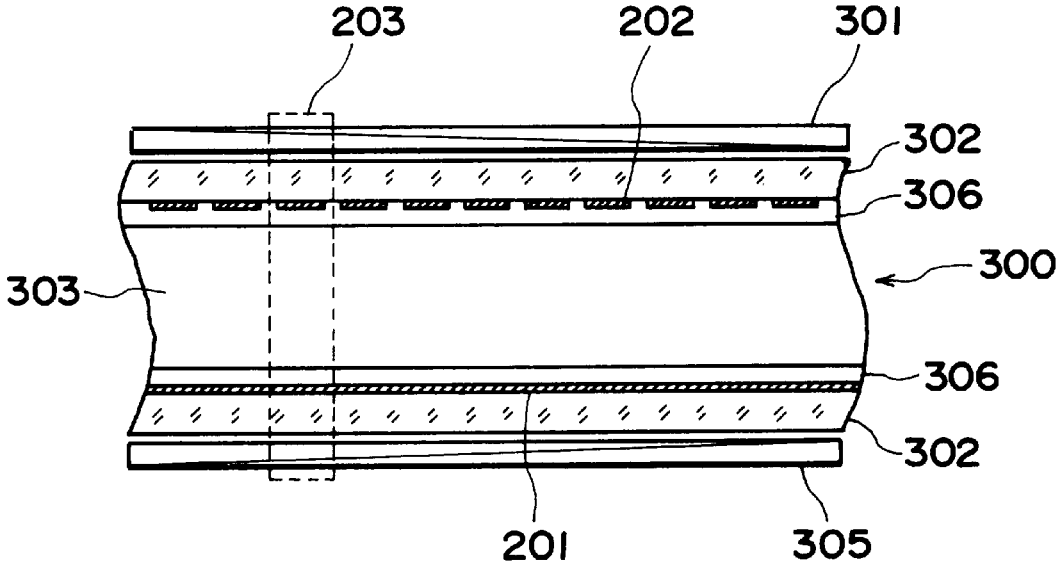

As shown in FIG. 3 which is a sectional view corresponding to FIG. 2, the liquid crystal panel 101 includes a cell or panel structure 300 comprising a pair of glass substrates 302 respectively having thereon a group of scanning signal electrodes 201 and a group of data signal electrodes 202 disposed intersecting each other so as to form an electrode matrix. The scanning signal electrodes 201 and the data signal electrodes 202 are covered with a pair of alignment films 306 which have been rubbed in mutually parallel and identical directions. Between the alignment films 306, a liquid crystal 303 is hermetically sealed to provide the cell or panel structure 300, which is sandwiched between a pair of polarizers 301 and 305 arranged to have cross nicol transmission axes, thereby constituting the liquid crystal panel 301. The liquid crystal 303 may comprise a liquid crystal having a memory characteristic, such as a chiral smectic liquid crystal or a bistable nematic liquid crystal. Such a chiral smectic liquid crystal 303, for example, may be disposed in a thickness of ca. 1–3 $\mu$m.

The scanning signal electrodes 201 and data signal electrodes 202 may be supplied with, e.g., scanning signals as shown at S1, S2, S3, . . . and data signals as shown at I, respectively, to apply voltages as shown at S2-I and S3-I to the liquid crystal at pixels formed at the intersections of scanning electrodes S2 and S3, respectively, with a data electrode I. The data signal waveform shown in FIG. 4 includes a data signal B and a data signal W to be supplied respectively in one selection period (1H) from the data electrode drive circuit 103*b*, depending on picture data "black" and "white", respectively.

By application of the waveforms at S2-I and S3-I, the respective pixels S2-I and S3-I are both reset into "black" in a former half of the respective scanning signals S2 and S3 (the second "1H" and third "1H", respectively) and then caused to retain "black" and be written into "white", respectively, in a latter half of the respective scanning signals S2 and S3 (the third "1H" and fourth "1H", respectively). Herein, a voltage (V2+V3) applied to a pixel for writing into "white" is defined as a drive voltage Vop.

Figure 4:
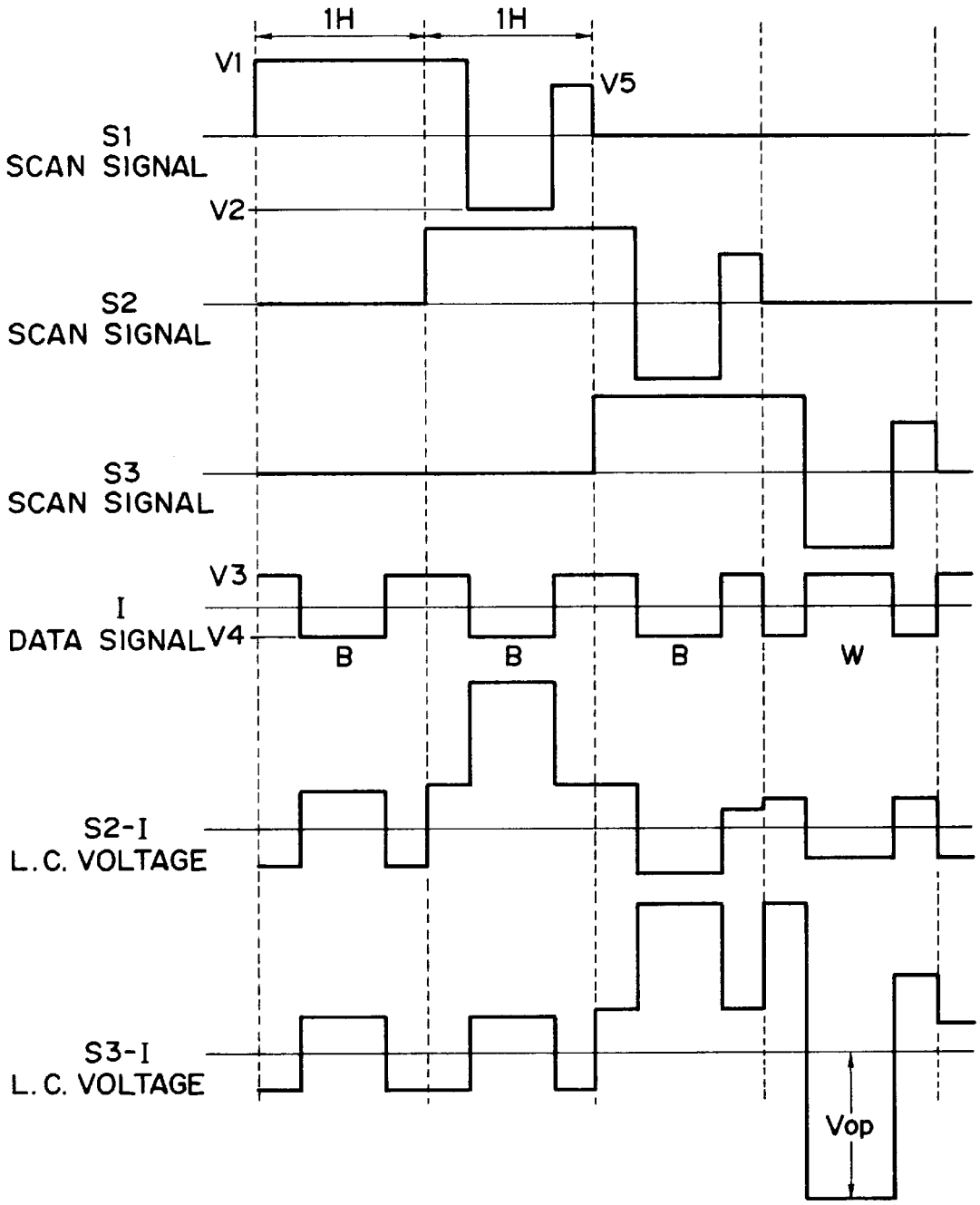
FIG. 4 is a diagram showing an example set of drive waveforms applied to such a liquid crystal panel in case where the liquid crystal panel uses a ferroelectric liquid crystal.

Voltages V1–V5 shown in FIG. 4 are supplied from the drive voltage generation circuit 104 so as to change depending on the drive voltage control signal inputted to the voltage generation circuit 104 by the panel control circuit 105 based on temperature data.

Figure 5A:
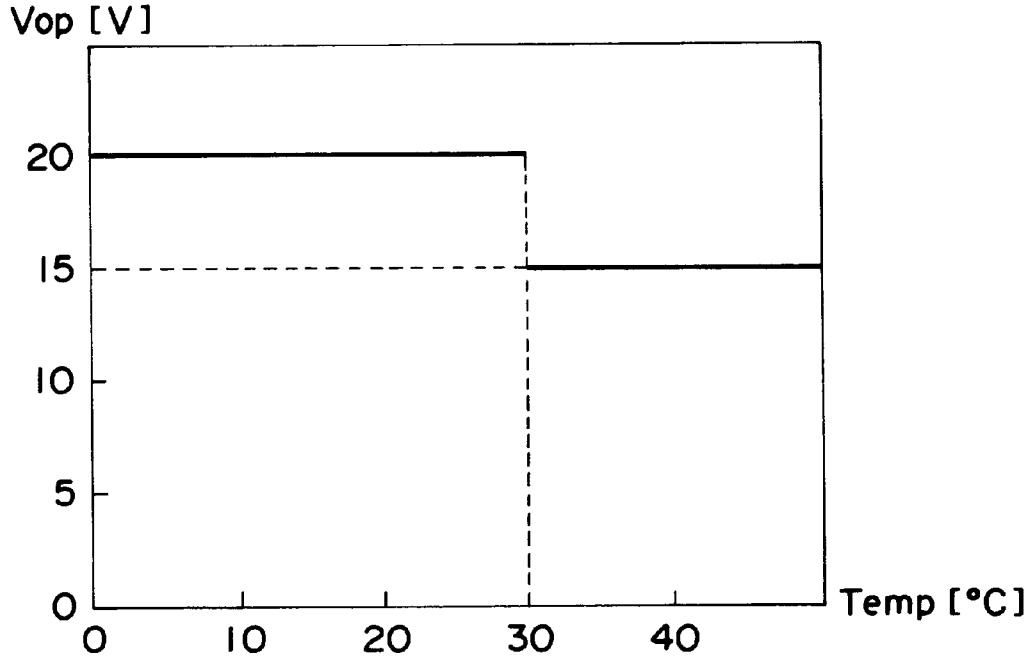
FIGS. 5A and 5B show a temperature-drive voltage diagram and a temperature-scanning pulse width diagram, respectively, in one embodiment of control.
Figure 5B:
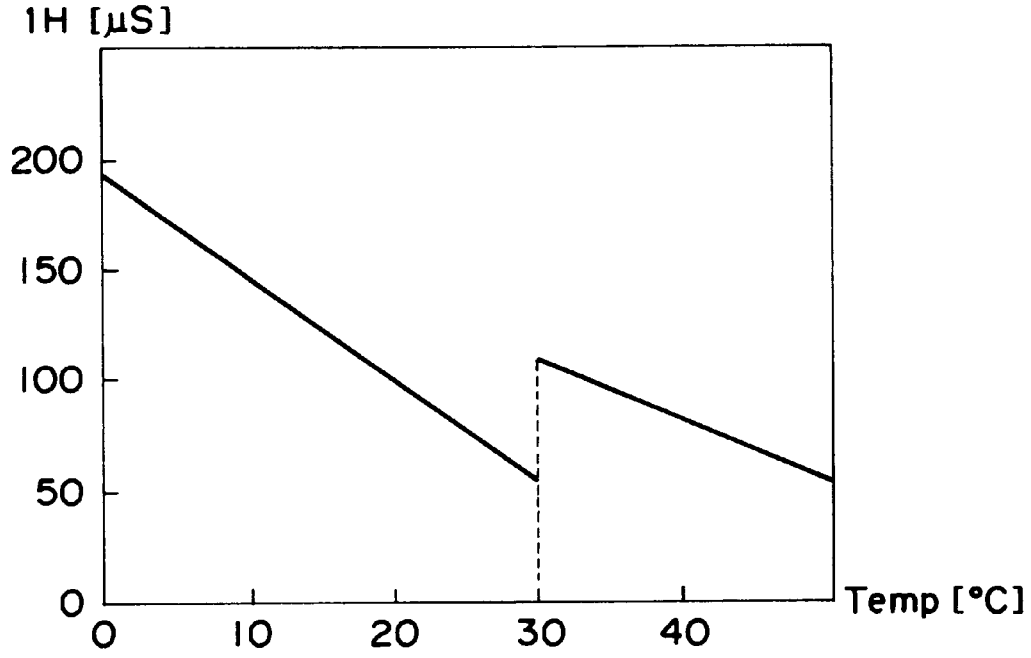

FIGS. 5A and 5B show an example of changes of drive voltage Vop and selection period 1H, respectively, depending on detected temperature Temp. More specifically, the panel control unit 105 judges whether the temperature of the liquid crystal panel 101 detected by the thermistor 102 is within a first temperature region having a prescribed temperature range (e.g., 0–30° C.) or within a second temperature region having a prescribed temperature range (e.g., ≧30° C.) and set the drive voltage Vop at a constant voltage of 20 volts in case where the temperature is within the first temperature region, or at another constant voltage of 15 volts in case where the temperature is within the second temperature region. By setting the drive voltage Vop for the lower temperature region to be larger than that in the higher temperature region as shown in FIG. 5A, a temperature compensation of the liquid crystal panel 101 is performed.

Further, the selection period (1H shown in FIG. 4) corresponding to a pulse width is controlled to be shortened within each temperature region, e.g., in a range of ca. 200 $\mu$s to 60 $\mu$s in the first temperature region and in a range of ca. 120 $\mu$s to 60 $\mu$s in the second temperature region as shown in FIG. 5B.

By controlling the pulse width of a drive signal (proportional to the selection period "1H") to be shortened with temperature increase in each temperature region, a temperature compensation of the liquid crystal panel 101 is performed. The rate of pulse width change (per unit temperature change) may be either identical or different for the respective temperature as may be set depending on the liquid crystal. At the boundary between the temperature regions, both the drive voltage and the pulse width are changed.

As shown in FIG. 5, for example, in the present invention and not only in this embodiment, it is generally preferred (i) to set a lower temperature region to have a larger temperature width than a higher temperature region and/or (ii) to set a larger rate of pulse width change per unit temperature change (e.g., in terms of $\mu$s/° C.) for a lower temperature region than a higher temperature region, so as to provide a broader temperature range allowing a high-speed scanning.

The control of the drive voltage and the selection period depending on the temperature of the liquid crystal panel may be effected by controlling the time of application and value of the scanning electrode control signal, data electrode drive control signal and drive voltage control signal by the panel control circuit 105 based on temperature data inputted thereto.

More specifically, the control of selection period "1H" may be effected by changing the frequency of a basic clock signal for generating liquid crystal drive waveforms supplied to the scanning electrode drive circuit 103*a* and the data electrode drive circuit 103*b*, and the switching between the drive voltages may be effected by changing a reference voltage supplies to the drive voltage generation circuit 104.

FIRST EXAMPLE

A first example of the above-described apparatus embodiment was constituted as follows.

A panel 101 having a liquid crystal cell structure as shown in FIG. 3 was prepared by using a pair of substrates 302 each provided with a rubbed 200 Å-thick polyimide alignment film 306 and disposed with a cell gap of ca. 1.0 m therebetween. The substrates were provided with a stripe electrodes so as to constitute a simple matrix electrode structure and provide a panel having a display area of 15 inches in diagonal size including 1280×1024 pixels. The cell gap was filled with ferroelectric liquid crystal 303 having the following physical properties.

Phase transition series (° C.)

$$\text{Iso.} \xrightarrow{92} \text{Ch.} \xrightarrow{85} S_A \xrightarrow{67} Sc^* \xrightarrow{-17} \text{Cryst.}$$

Spontaneous polarization Ps=6 nC/cm$^2$ (30° C.)

Tilt angle Ⓗ=15 deg. (30° C.)

Dielectric anisotropy $\Delta\epsilon$=−0.2 (30° C.)

The liquid crystal material incorporated in the panel was examined with respect to its smectic layer structure according to a method reported by Clark and Lagerwall (Japan Display '86, Sep. 30–Oct. 2, 1986, pp. 456–458), whereby the liquid crystal material was found to exhibit a chevron layer structure.

The liquid crystal panel 101 thus prepared was incorporated in an apparatus shown in FIG. 1 and driven by application of drive signals as shown in FIG. 4 while controlling the drive voltage Vop and selection period 1H as shown in FIG. 5 over a temperature range of 0–50° C., whereby good pictures could be displayed over the entire panel in either of the first temperature region (0–30° C.) and the second temperature region (30–50° C.).

SECOND EXAMPLE

In this example, the liquid crystal panel of the first example was modified in the following manner while the electrodes and polarizers were disposed in the same manner.

One of a pair of substrates 302 was coated with a ca. 10 nm-thick polyimide film 306 and rubbed in one direction with nylon cloth, and the other substrate was subjected to a homeotropic aligning treatment by application of a silane coupling agent (ODS-E). The two substrates were superposed each other with silica beads of 2.0 $\mu$m in average diameter disposed therebetween and bonded to each with a sealing agent.

The cell gap was filled with a ferroelectric liquid crystal showing the following properties and exhibiting a bent-free so-called bookshelf layer structure instead of a chevron layer structure when incorporated in the above-prepared panel.

Phase transition series (° C.)

$$\text{Iso.} \xrightarrow{79} S_A \xrightarrow{53} Sc^* \xrightarrow{-14} \text{Cryst.}$$

Spontaneous polarization Ps=30 nC/cm$^2$ (30° C.)

Tilt angle Ⓗ=20 deg. (30° C.)

Dielectric anisotropy $\Delta\epsilon$=0 (30° C.)

The liquid crystal panel was incorporated in the apparatus system of FIG. 1 similarly as in Example 1 and driven under the following conditions of drive voltage Vop and frequency f (=1/(1024×1H)), whereby good pictures were displayed over the entire area of the panel 101 over a temperature range of 5–40° C.

| Temp. (° C.) | 5–30 | 30–40 |
|---|---|---|
| Vop (V) | 20 | 15 |
| f (Hz) | 7–26 | 14–20 |
| 1H ($\mu$s) | 140–38 | 70–49 |

In the above-described embodiment, the entire liquid crystal drive temperature range has been divided into two temperature regions. In the present invention, however, a further better quality of picture display becomes possible if the entire drive temperature range is divided into three or more temperature regions while effecting similar control in each temperature region and among different temperature regions as described above.

SECOND EMBODIMENT

Figure 6:
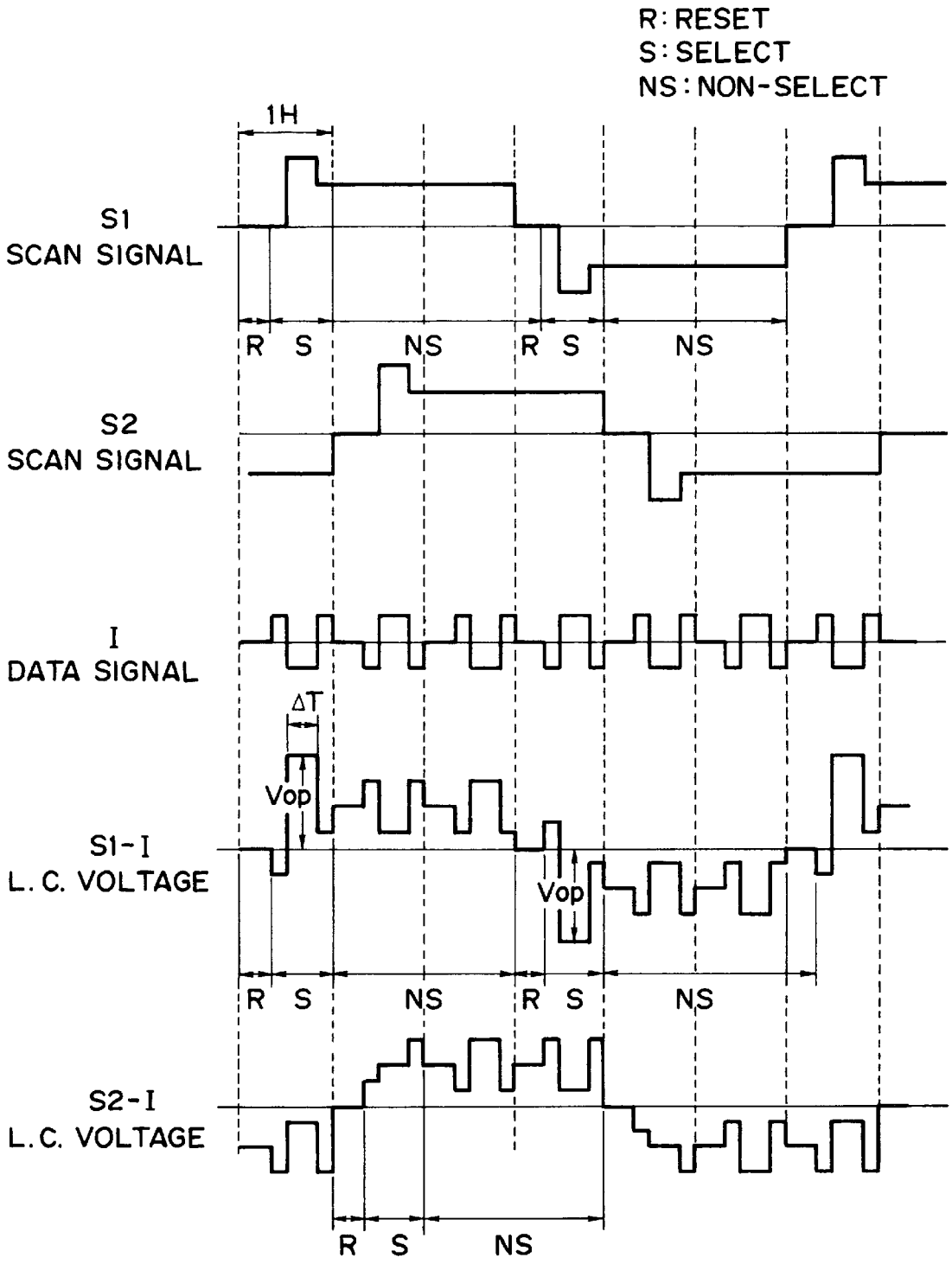
FIGS. 6 and 7 are diagrams showing example sets of drive waveforms applied to liquid crystal panels in case where the liquid crystal panels use an anti-ferroelectric liquid crystal and a chiral nematic liquid crystal, respectively.

This embodiment uses an entire apparatus structure as shown in FIG. 1, and a liquid crystal panel structure as shown in FIGS. 2 and 3 similarly as the first embodiment described above, but an anti-ferroelectric liquid crystal assuming three stable states is used and subjected to multiplex drive by using a set of drive waveforms as shown in FIG. 6 while controlling the drive voltage Vop and selection period according to a temperature compensation scheme similarly as shown in FIG. 5 except for specific value shown therein.

More specifically, referring to FIG. 6, a scanning signal (S1, S2, . . . ) is composed of a reset portion R, a selection portion S and a non-selection portion NS. In the non-selection period NS, an offset voltage is applied. The scanning signal may be polarity-inverted frame by frame as shown. Vop refers to a voltage applied to the liquid crystal in a selection period at S1-I. In this embodiment, in applying the temperature compensation scheme as shown in FIG. 1, plural temperature regions each of a constant Vop, and a range and a rate of change of selection period 1H in each temperature range may be adjusted depending on the liquid crystal cell design factors and the properties of the liquid crystal used.

In a specific example according to this embodiment, a liquid crystal panel having 640×480 pixels was prepared so as to be driven at a duty of 1/240 (with division of the picture area into two sections) by disposing an anti-ferroelectric liquid crystal having an anti-ferroelectric phase ($S^*_{CA}$) and physical properties as shown below in a thickness of ca. 2 $\mu$m.

Phase transition series (° C.)

$$\text{Iso.} \xrightarrow{101} S_A \xrightarrow{83} Sc^* \xrightarrow{82} S^*_{CA}$$

Spontaneous polarization Ps=80 nC/cm$^2$ (25° C.)

Tilt angle Ⓗ=27.1 deg. (25° C.)

One polarizer was disposed to have a polarization axis substantially coinciding with an average molecular axis of the liquid crystal in the anti-ferroelectric state. Other structures of the panel were similar to those in the first example described above.

The liquid crystal panel was driven by application of drive waveforms shown in FIG. 6 and the following conditions of Vop, f (=1/(1H×40)) and ΔT(=1H/3, selection pulse width as shown in FIG. 6) specified for respective temperature regions, whereby good pictures were displayed over the entire area of the panel 101 over an entire temperature range of 0–50° C.

| Temp. (° C.) | 0–35 | 35–50 |
|---|---|---|
| Vop (V) | 40 | 30 |
| f (Hz) | 1.4–3.1 | 1.7–14 |
| ΔT (μs) | 1000–450 | 800–100 |
| 1H (μs) | 3000–1350 | 2400–300 |

THIRD EMBODIMENT

Figure 7:
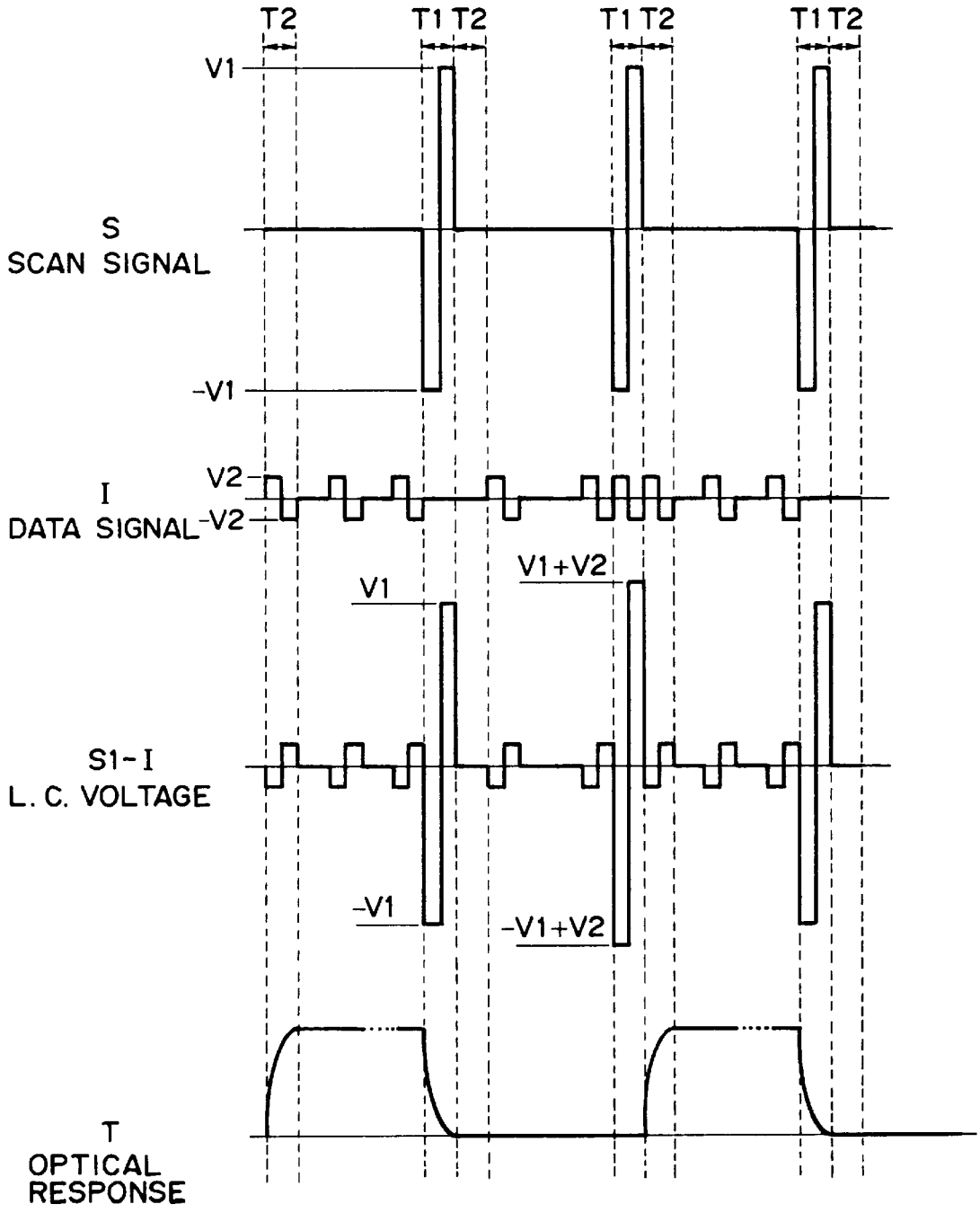

This embodiment uses an entire apparatus structure as shown in FIG. 1 and a liquid crystal panel structure as shown in FIGS. 2 and 3, similarly as the first embodiment, but a liquid crystal material showing a bistable twisted nematic mode is used. In this embodiment, a drive waveform as shown in FIG. 7 (and disclosed in JP-A 6-230751) may be used. When the drive waveform shown in FIG. 7 is used, nematic liquid crystal molecules are caused to stand up by application of a prescribed voltage in period T1 and then caused to select between a 2π-twisted state (in case of application of a voltage below a threshold voltage) and a non-twisted state (in case of application of a voltage exceeding a threshold voltage), thereby determining a "black" or a "white" display state. During the drive, the drive voltage Vop and selection period 1H may be controlled according to a temperature compensation scheme similarly as shown in FIG. 5 except for specific values shown therein. Also in this embodiment, plural temperature ranges of constant voltages Vop, values of Vop for each temperature region, and a range and a rate of change of selection period in each temperature region may be adjusted depending on the liquid crystal cell design factors and the properties of the liquid crystal used.

In a specific example according to this embodiment, a liquid crystal panel was prepared as follows.

Two glass substrates 301 and 302 were provided with ITO stripe electrodes 201 and 202 and further coated with polyimide alignment films 306. Further, the thus-treated substrates were superposed with each other with spacer beads dispersed therebetween so that their rubbed directions were parallel and opposite to each other and the electrodes on the substrates 201 and 202 formed an electrode matrix, thereby forming a blank cell structure having a cell spacing of 2.0 μm as shown in FIG. 3. Then, the cell was filled with a chiral nematic liquid crystal having a helical pitch P=3.4 μm formed by adding an optical active agent ("S-811", available from Merck Co.) to a nematic liquid crystal composition ("KN-4000", available from Chisso K.K.). Further, a pair of polarizers were disposed to sandwich the cell to form a liquid crystal panel. The liquid crystal in the cell exhibited a pretilt angle α=4 deg and π-twist alignment as an initial alignment.

The liquid crystal panel (101) was incorporated in an apparatus system shown in FIG. 1 and driven by application of drive waveforms shown in FIG. 7 (wherein periods T1 and T2 are drawn in almost identical lengths but actually T1 was considerably longer than T2) under conditions including: reset voltage (scanning signal: V1=±30 volts), selection voltage (data signal: V2=±1.5–2.5 volts) and a reset pulse width (T1)=2 ms) to effect refresh scanning at a duty of 1/100, whereby a 0-twist uniform alignment was formed to provide a "bright" display state.

Then, the panel was driven under the same conditions except for changing the selection voltage to 0 volt, whereby a 2π alignment state was formed to provide a "dark" display state giving a contrast of ca. 50 with the above-formed "bright" display state.

Then, the liquid crystal panel 101 was driven under the following conditions of Vop, f(=1/(1H×100)) and T2(=1H) specified for respective temperature regions, whereby good pictures were displayed over the entire panel area over a temperature range of 15–40° C.

| Temp. (° C.) | 15–25 | 25–40 |
|---|---|---|
| Vop (V) | 2 | 1.5 |
| f (Hz) | 28–50 | 33–56 |
| T2 (=1H) (μs) | 350–200 | 300–180 |

As described above, according to the present invention, a liquid crystal device is driven over an entire operational temperature range divided into a plurality of temperature regions in which the liquid crystal device is driven under application of respective constant voltages different from each other to effect temperature compensation by changing the drive signal pulse in each temperature region. As a result, the liquid crystal device can be driven with appropriate temperature compensation over a wide temperature range while requiring only a simple apparatus structure for the temperature compensation.

As a result, normal picture can be displayed according to various liquid crystal display modes over a wide temperature range by using a simple drive control circuit, thus providing an inexpensive display system (apparatus and method) with excellent display characteristics.

What is claimed is:

1. A liquid crystal apparatus, comprising:

a liquid crystal device comprising a pair of substrates having thereon groups of electrodes disposed so as to form an electrode matrix, and a liquid crystal disposed between the substrates so as to be driven by a drive voltage based on a drive signal supplied via the electrodes, drive voltage generation means for generating a drive voltage for driving the liquid crystal, drive signal generation means for generating a drive signal corresponding to the drive voltage, temperature-detection means for detecting a temperature of the liquid crystal device, and control means for (i) setting plural different temperature regions, (ii) judging in which of the plural temperature regions the temperature of the liquid crystal device is present based on detected temperature data from the temperature-detection means, and (iii) in each temperature region, controlling the drive voltage generation means to generate a constant drive voltage different from that in another temperature region and controlling the drive signal generation means to generate a drive signal having a pulse width varying depending on the detected temperature data.

2. A liquid crystal apparatus according to claim 1, wherein said plural different regions include a lower temperature region and a higher temperature region in which the drive voltage generation means is controlled to generate a higher constant voltage and a lower constant voltage, respectively.

3. A liquid crystal apparatus according to claim 1, wherein the drive signal generation means is controlled to generate a drive signal having a pulse signal which becomes shorter with temperature increase.

4. A liquid crystal apparatus according to claim 1, wherein said liquid crystal is a liquid crystal having a memory characteristic.

5. A liquid crystal apparatus according to claim 4, wherein said liquid crystal is a ferroelectric liquid crystal or an anti-ferroelectric liquid crystal.

6. A liquid crystal apparatus according to claim 4, wherein said liquid crystal is a bistable nematic liquid crystal.

7. A driving method for a liquid crystal apparatus of the type including a liquid crystal device comprising a pair of substrates having thereon groups of electrodes disposed so as to form an electrode matrix, and a liquid crystal disposed between the substrates so as to be driven by a drive voltage based on a drive signal supplied via the electrodes, and temperature-detection means for detecting a temperature of the liquid crystal device; said driving method, comprising:

driving the liquid crystal device based on temperature data from the temperature detection means over an operational temperature range including a first temperature region and a second temperature region so that when the temperature of the liquid crystal device is in the first temperature region, a first constant drive voltage is applied to the liquid crystal device for a pulse width varying depending on the temperature of the liquid crystal device, and when the temperature of the liquid crystal device is in a second temperature region, a second constant voltage is applied to the liquid crystal for a pulse width varying depending on the temperature of the liquid crystal device.

8. A driving method according to claim 7, wherein the first temperature region is lower than the second temperature region, and the first constant voltage is higher than the second constant voltage.

9. A driving method according to claim 7, wherein the first or second constant voltage is applied for a pulse width which becomes shorter with temperature increase.

10. A driving method according to claim 7, wherein at a boundary between the first and second temperature regions, both the voltage and the pulse width are changed.

11. A driving method according to claim 8, wherein the first temperature region has a larger temperature range than second temperature region.

12. A driving method according to claim 8, wherein a larger pulse change rate per unit temperature change is set in the first temperature region than in the second temperature region.

* * * * *

UNITED STATES PATENT AND TRADEMARK OFFICE

CERTIFICATE OF CORRECTION

PATENT NO. : 6,037,920
DATED : March 14, 2000
INVENTOR(S) : ATSUSHI MIZUTOME ET AL.

It is certified that error appears in the above-identified patent and that said Letters Patent is hereby corrected as shown below:

ON THE TITLE PAGE:

[56] References Cited, under FOREIGN PATENT DOCUMENTS

"60- 123825 7/1995" should read --60-123825 7/1985--.

IN THE DRAWINGS:

Sheet 1, FIG. 1, "ELECTODE" should read --ELECTRODE--.

COLUMN 1:

Line 12, "apparatus" should read --apparatuses--.

COLUMN 2:

Line 28, "a" should be deleted;
Line 41, "case" should read --the case--; and
Line 48, "case" should read --the case--.

COLUMN 5:

Line 17, "1.0 m" should read --1.0 μm--;
Line 18, "a" should be deleted; and
Line 60, "each" should read --with each--.

COLUMN 8:

Line 46, "normal" should read --a normal--.

UNITED STATES PATENT AND TRADEMARK OFFICE

CERTIFICATE OF CORRECTION

PATENT NO. : 6,037,920
DATED : March 14, 2000
INVENTOR(S) : ATSUSHI MIZUTOME ET AL.

It is certified that error appears in the above-identified patent and that said Letters Patent is hereby corrected as shown below:

COLUMN 10:

Line 28, "than"should read --than the--.

Signed and Sealed this

Fifth Day of June, 2001

*Attest:*

*Attesting Officer*

Nicholas P. Godici

NICHOLAS P. GODICI

*Acting Director of the United States Patent and Trademark Office*

UNITED STATES PATENT AND TRADEMARK OFFICE

CERTIFICATE OF CORRECTION

PATENT NO. : 6,037,920
DATED : March 14, 2000
INVENTOR(S) : Atsushi Mizutome et al It is certified that error appears in the above-identified patent and that said Letters Patent is hereby corrected as shown below:

On The Title Page:
[56] References Cited, under FOREIGN PATENT DOCUMENTS
"60- 123825 7/1995" should read -- 60-123825 7/1985 --.

In The Drawings:
Sheet 1, FIG. 1, "ELECTODE" should read -- ELECTRODE --.

Column 1:
Line 12, "apparatus" should read -- apparatuses --.

Column 2:
Line 28, "a" should be deleted;
Line 41, "case" should read --the case --; and
Line 48, "case" should read -- the case --.

Column 5:
Line 17, "1.0 m" should read -- 1.0 μm --;
Line 18, "a" should be deleted; and
Line 60, "each" should read -- with each --.

Column 8:
Line 46, "normal" should read -- a normal --.

UNITED STATES PATENT AND TRADEMARK OFFICE

CERTIFICATE OF CORRECTION

PATENT NO. : 6,037,920
DATED : March 14, 2000
INVENTOR(S) : Atsushi Mizutome et al.

It is certified that error appears in the above-identified patent and that said Letters Patent is hereby corrected as shown below:

Column 10:
Line 28, "than" should read -- than the --.

Signed and Sealed this

Seventh Day of August, 2001

*Attest:*

Nicholas P. Godici

NICHOLAS P. GODICI
*Acting Director of the United States Patent and Trademark Office*

*Attesting Officer*